United States Patent [19]

Morikawa

[11] Patent Number: 4,541,387

[45] Date of Patent: Sep. 17, 1985

[54] SYSTEM FOR CONTROLLING FUEL INJECTION FOR MULTIPLE-DISPLACEMENT ENGINES

[75] Inventor: Koji Morikawa, Tokyo, Japan

[73] Assignee: Fuji Jukogyo Kabushiki Kaisha, Tokyo, Japan

[21] Appl. No.: 494,205

[22] Filed: May 13, 1983

[30] Foreign Application Priority Data

May 18, 1982 [JP] Japan ..... 57-83617

[51] Int. Cl.[4] ..... F02D 17/00

[52] U.S. Cl. ..... 123/481; 123/198 F

[58] Field of Search ..... 123/481, 198 F

[56] References Cited

U.S. PATENT DOCUMENTS

| | | | |
|---|---|---|---|
| 2,771,867 | 11/1956 | Peras | 123/481 |
| 3,756,205 | 9/1973 | Frost | 123/481 |
| 4,040,395 | 8/1977 | Demetrescu | 123/481 |
| 4,061,055 | 12/1977 | Iizuka et al. | 123/481 |
| 4,144,864 | 3/1979 | Kato et al. | 123/481 |
| 4,194,417 | 3/1980 | Kato et al. | 123/198 F |
| 4,204,514 | 5/1980 | Ishida | 123/481 |
| 4,276,863 | 7/1981 | Sugasawa et al. | 123/481 |
| 4,391,255 | 7/1983 | Staerzl | 123/481 |
| 4,398,520 | 8/1983 | Schulz et al. | 123/481 |

FOREIGN PATENT DOCUMENTS

| | | | |
|---|---|---|---|
| 2612172 | 9/1977 | Fed. Rep. of Germany | 123/481 |

*Primary Examiner*—Ira S. Lazarus

*Attorney, Agent, or Firm*—Martin A. Farber

[57] ABSTRACT

A system for controlling fuel injection for a multiple-displacement engine in which the number of operating cylinder changes according to the load on the engine by cutting off fuel to some of cylinders. The engine has solenoid-operated fuel injection valves and a switch is provided for rendering each solenoid-operated fuel injection valve inoperative. A sensor is provided for detecting load on the engine and for producing an output dependent on the load. A fuel injection control circuit is responsive to the output of the sensor for operating the switches to cut off the fuel to the corresponding cylinder. The fuel injection control circuit is so arranged to cut off the fuel to cylinders in accordance with idle cylinder patterns which are such that particular cylinders are not repeatedly idled and such that the number of idling cylinders by the fuel cut-off decreases with an increase of the load on the engine.

2 Claims, 6 Drawing Figures

SYSTEM FOR CONTROLLING FUEL INJECTION FOR MULTIPLE-DISPLACEMENT ENGINES

BACKGROUND OF THE INVENTION

The present invention relates to a system for controlling fuel injection for a gasoline engine, in which the number of cylinders supplied with fuel is selected in accordance with the load on the engine, whereby the total, that is the number of operating cylinders can be controlled. Such an engine is called a multiple-displacement engine.

In order to adjust the output of a conventional engine having a carburetor, the amount of intake air-fuel mixture is adjusted by the actuation of a throttle valve, keeping all of the cylinders in operating condition. In such an engine, at light load, pumping losses are comparatively large, which results in an increase of fuel consumption.

As an improvement system, a multiple-displacement engine has been proposed in which the number of operating cylinders is changed by stopping operation of intake and exhaust valves of selected cylinders or cutting off the fuel supply in order to fully operate the remaining cylinders to improve fuel consumption.

Japanese patent laid-open specification No. 53–21327 and Japanese patent publication No. 54–266 disclose such systems. However, in these systems, since only predetermined particular cylinders idle without firing, the temperature of the particular cylinders decreases, which is disadvantageous to engine operation.

SUMMARY OF THE INVENTION

An object of the present invention is to provide a control system for controlling the number of the cylinders of a gasoline engine, in which cylinders supplied with fuel are changed at random in order to prevent particular cylinders from being kept idle and to prevent fluctuation of the output of the engine.

According to the present invention, there is provided a system for controlling fuel injection for a multiple-displacement engine having a solenoid-operated fuel injection valve for each cylinder, a throttle plate, an accelerator pedal, and an electronic control unit, comprising: switch means for rendering each solenoid-operated fuel injection valve inoperative; means for detecting load on the engine and for producing an output dependent on the load; a fuel injection control circuit responsive to the output of the load detecting means for operating the switch means to cut off the fuel to the corresponding cylinder; the fuel injection control circuit being so arranged to cut off the fuel to cylinders via corresponding said switch means and such that the number of idle cylinder by the fuel cut-off progressively decreases with increase of the load on the engine.

The present invention will be more apparent from the following description made with reference to the accompanying drawings.

DETAILED DESCRIPTION OF THE PREFERRED EMBODIMENT

Figure 1:
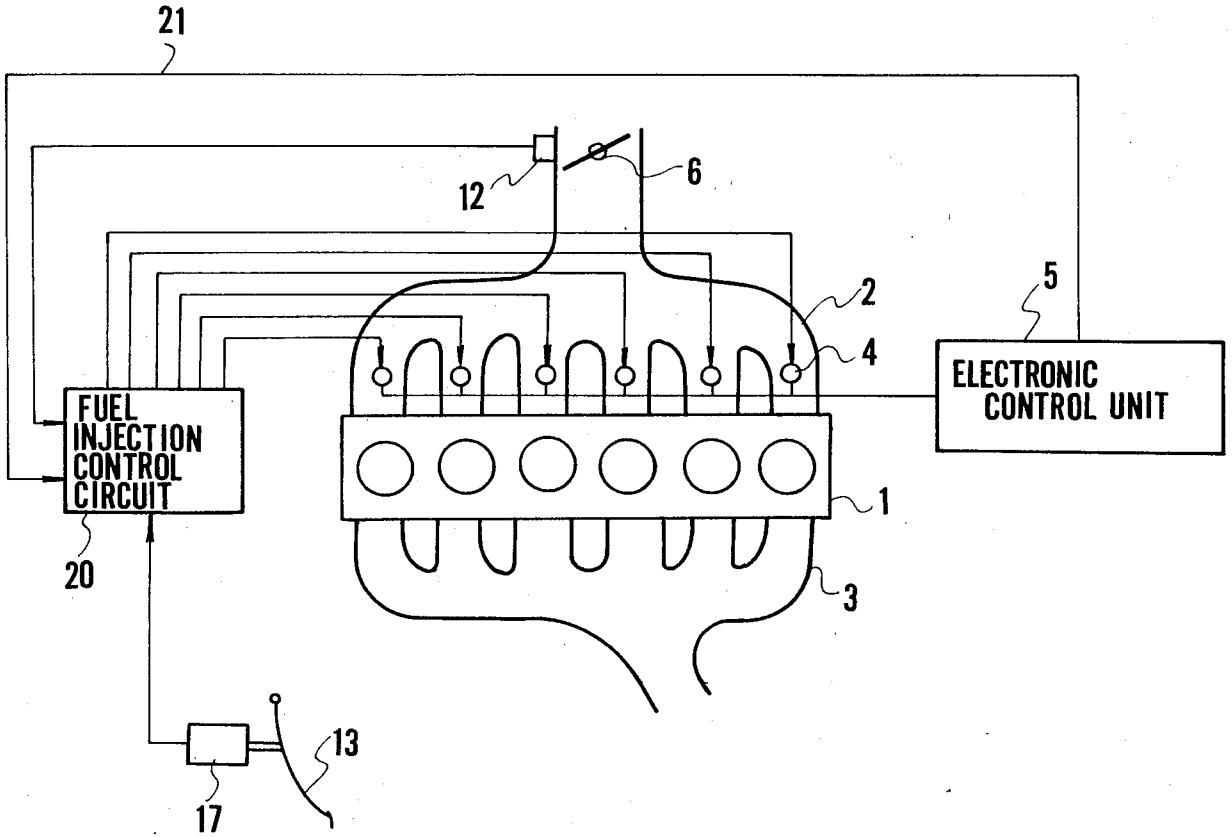
FIG. 1 is a diagrammatic view of a control system in accordance with the present invention.

Referring to FIG. 1, a six cylinder gasoline engine 1 is provided with an intake manifold 2 and an exhaust manifold 3. Each cylinder of the engine 1 has a solenoid-operated fuel injection valve 4 through which fuel is supplied to the intake manifold 2 by a signal from an electronic control unit (ECU) 5 which a well known system.

Figure 2:
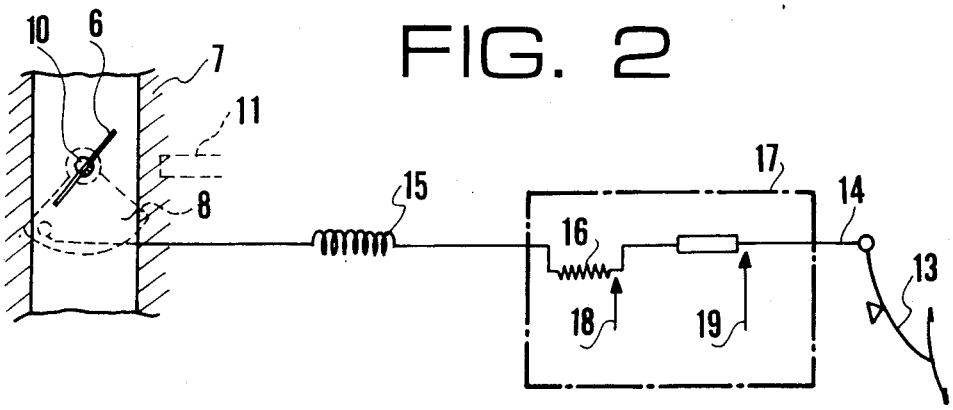
FIGS. 2 to 4 show a construction with a relationship between a throttle plate and an accelerator pedal, and showing the operation dependent on the accelerator pedal in several positions.
Figure 3:
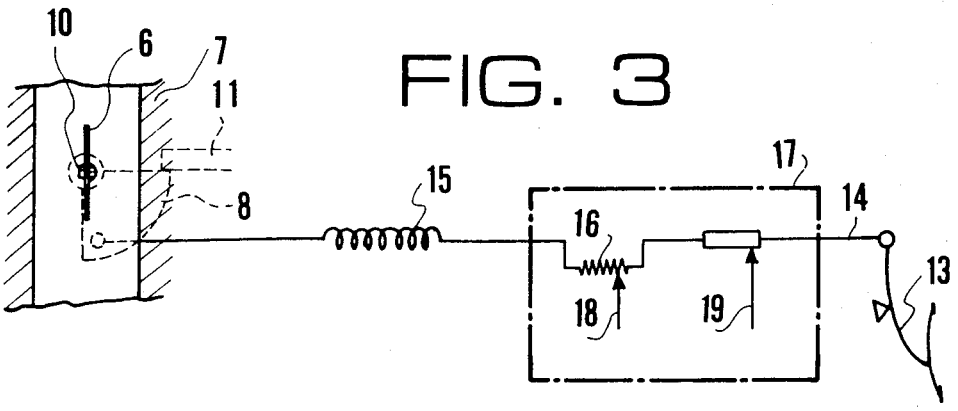

Referring to FIG. 2, a throttle plate 6 provided in a throttle body 7 is connected to a throttle lever 8 outside of the throttle body through a throttle shaft 10. The throttle lever 8 is adapted to engage with a stopper 11 at a full throttle position as shown in FIG. 3. The opening angle of the throttle plate 6 is detected by a throttle position sensor 12 (FIG. 1).

The throttle lever 8 is connected to an accelerator pedal 13 through a cable 14 containing a coil spring 15 and an electrical resistor element 16. A pair of stationary contacts 18 and 19 are provided to engage with the cable and the resistor element 16 to form a potentiometer as an accelerator pedal position sensor 17 (FIG. 1).

Figure 4:
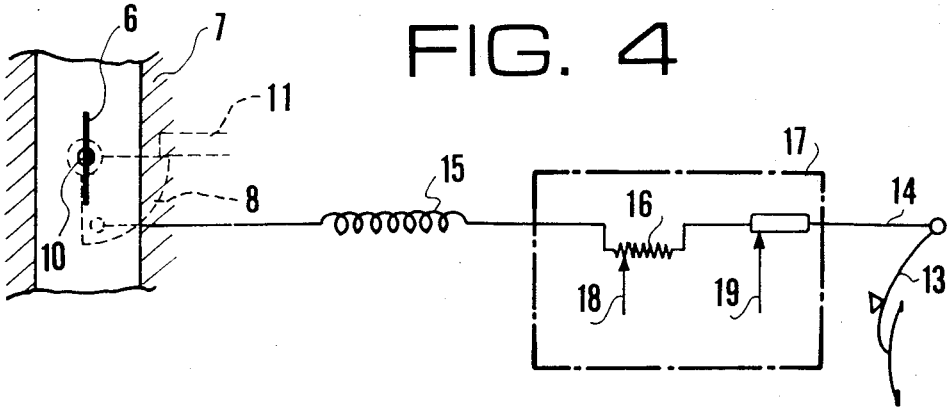

When the accelerator pedal 13 is depressed, the throttle plate 6 is rotated in the counterclockwise direction in FIG. 2. After the throttle lever 8 has engaged with the stopper 11 (FIG. 3), the spring 15 is expanded, so that the resistor element 16 moves to the right to engage with the contact 18. FIG. 4 shows a state when the accelerator pedal is fully depressed. Thus, the depression angle of the accelerator pedal 13 after the full throttle position is represented by the output voltage of the potentiometer as the accelerator pedal position sensor 17.

Outputs of the throttle position sensor 12 and the accelerator pedal position sensor 17 are applied to a fuel injection control circuit 20. The fuel injection control circuit 20 is also applied with a fuel injection timing signal from the electronic control circuit 5 by a line 21.

Figure 5:
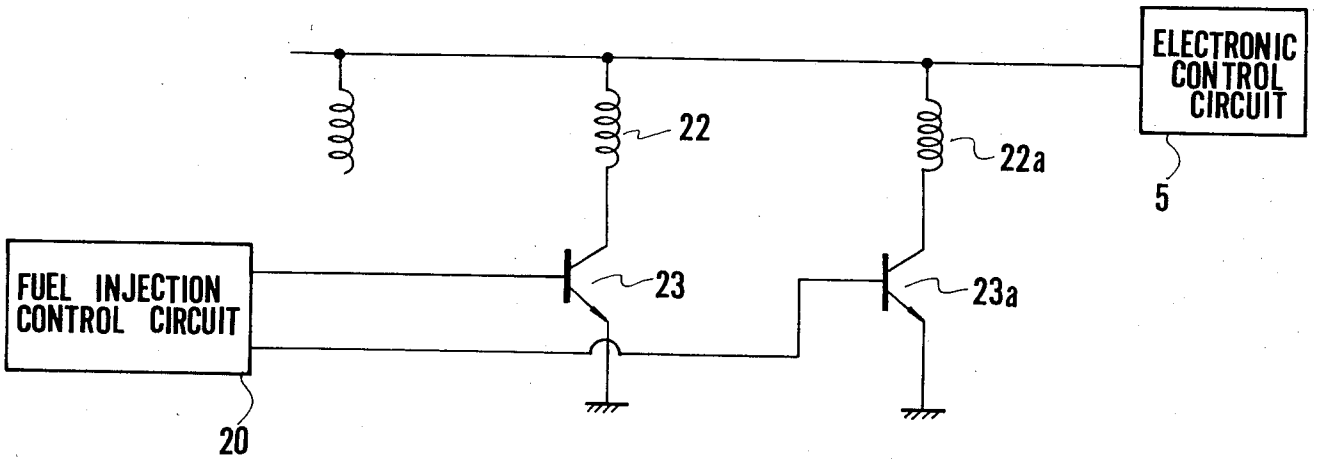
FIG. 5 shows a circuit for solenoids of fuel injection valves.

Referring to FIG. 5, a solenoid 22 of each fuel injection valve 4 is connected parallel to the electronic control circuit 5 to be supplied with a voltage for fuel injection. In the circuit of each solenoid 22, a transistor switch 23 is connected in series. A base of each transistor is 23 adapted to be supplied with a control signal from the fuel injection control circuit 20. The fuel injection control circuit 20 is provided with a microcomputer for controlling the fuel injection of each fuel injection valve in dependency on a program with reference tables.

Table I shows percentage of idle cylinder which varies in accordance with the accelerator pedal depression angle. It will be seen that the percentage of idle cylinders is fixed to 40% when the throttle plate opening angle is between 0° and 80° (full throttle open), and after that the percentage decreases with an increase of the accelerator pedal depression angle.

TABLE I

| Accelerator pedal depression angle | Throttle plate opening angle | Percentage of idle cylinder |
|---|---|---|
| 70°(full stroke) | 80°(full throttle open) | 0% |
| 65° | 80°(full throttle open) | 5% |
| 60° | 80°(full throttle open) | 10 % |

TABLE I-continued

| Accelerator pedal depression angle | Throttle plate opening angle | Percentage of idle cylinder |
|---|---|---|
| 55° | 80°(full throttle open) | 15% |
| . | . | . |
| . | . | . |
| . | . | . |
| 30° | 80°(full throttle open) | 40% |
| 25° | 50° | 40% |
| 20° | 40° | 40% |
| . | . | . |
| . | . | . |
| . | . | . |
| 0 | 0 | 40% |

The percentage P of the idling cylinders can be expressed by following formula.

$$P = \frac{I}{F+I} \times 100$$

where I is the number of the idle cylinder in one cycle of an idle cylinders pattern, and F is the number of the firing cylinders in one cycle, whereas F+I represents all the cylinders of the engine.

Tables II and III show examples of idle cylinder patterns of 10% and 20%, respectively, where the figures represent cylinder No. and the mark "X" represents fuel cut off and "O" represents the firing condition.

TABLE II

| Firing order | Idle cylinder pattern ← One cycle | | | | → | repeat |
|---|---|---|---|---|---|---|
| 1 | X | O | O | O | O | X . . . |
| 6 | O | O | O | O | O | O . . . |
| 3 | O | O | O | X | O | O . . . |
| 2 | O | O | O | O | O | O . . . |
| 5 | O | X | O | O | O | O . . . |
| 4 | O | O | O | O | O | O . . . |

TABLE III

| Firing order | ← One cycle | | | | → | repeat |
|---|---|---|---|---|---|---|
| 1 | X | O | O | O | O | X . . . |
| 6 | O | O | O | O | X | O . . . |
| 3 | O | O | O | X | O | O . . . |
| 2 | O | O | X | O | O | O . . . |
| 5 | O | X | O | O | O | O . . . |
| 4 | X | O | O | O | O | X . . . |

Describing the operation of the system, the fuel injection control circuit 20 determines whether the throttle plate 6 is fully opened. If the throttle plate is in the full throttle open position, the depression angle of the accelerator pedal is entered. When the depression angle is 60° (3rd line condition in Table I), the idling cylinder percentage is 10% with reference to table I. Therefore, table II the 10% pattern is used. In accordance with the pattern, at the first cycle of the firing, the control circuit 20 does not send a signal to the base which is operatively connected to the solenoid 22*a* for transistor 23*a* of the No. 1 cylinder to off the transistor, so that the fuel injection valve 4 of the No. 1 cylinder does not open. This cuts off the fuel to this cylinder at the fuel injection timing signal from the control unit 5. Therefore, the No. 1 cylinder idles during the first cycle. During the second and fourth cycles, fuel to the No. 5 and No. 3 cylinders is cut off. During the third and fifth cycles, all cylinders operate.

The pattern of the table II is repeated to operate the engine. Similarly, for example, when the depression angle of the accelerator pedal is 50°, the idle cylinder percentage is 20% (not shown in Table I). Therefore, fuel injection is performed in accordance with table III.

At a light load, where the throttle plate is not the full throttle open position, the number of idling cylinder is not changed and the percentage is fixed to 40% as described above. Under such a light load condition, the position of the throttle plate causes a variation of inducted air flow rate, which performs a fine control of fuel supply.

Figure 6:
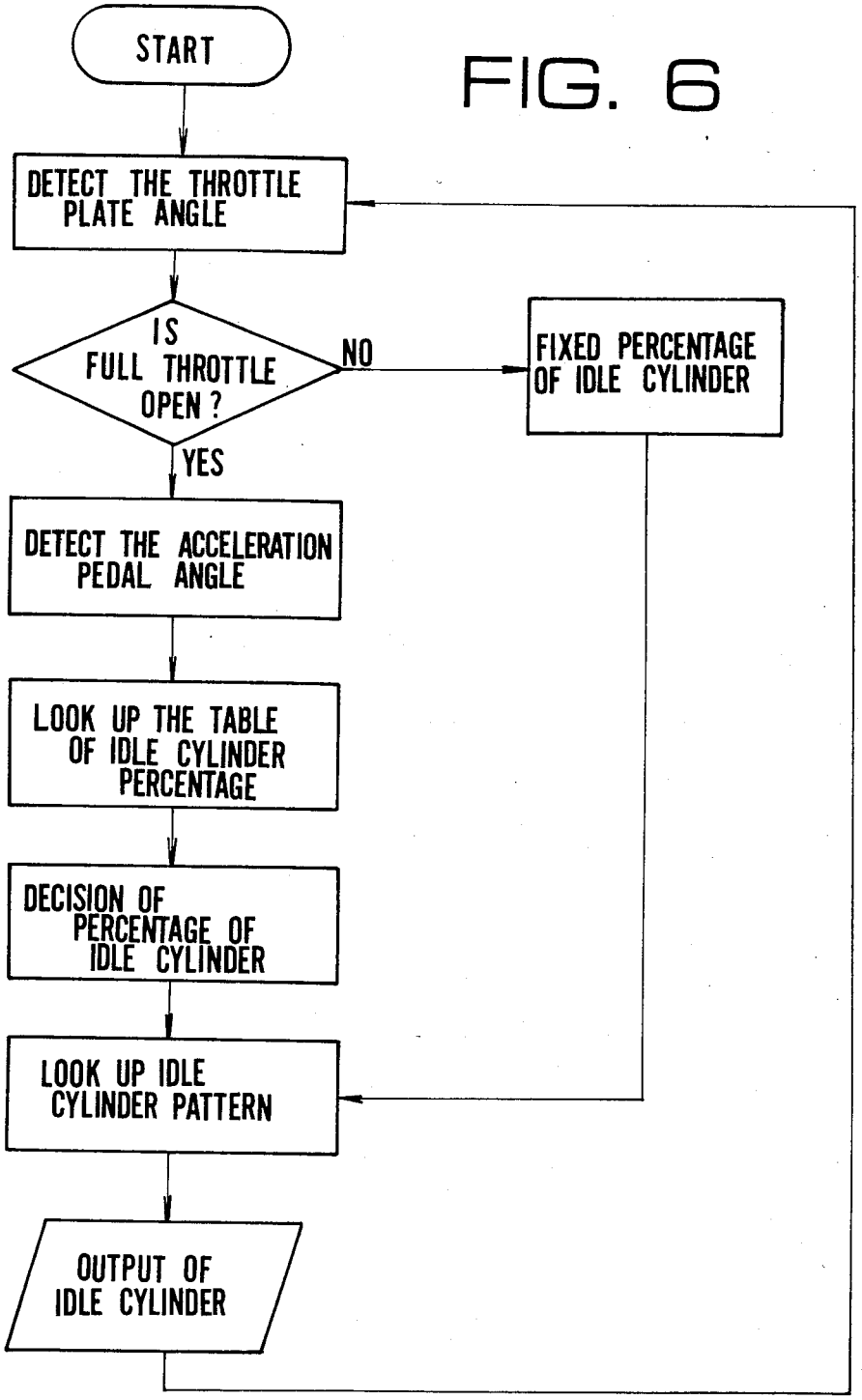
FIG. 6 is a flow chart of a program for the system of the present invention.

FIG. 6 shows a flow chart of the above described program.

From the foregoing, it will be noted that some of cylinders of the engine idle at random selected idle cylinder patterns according to the load conditions, so that fluctuations of combustion, and of output can be remarkably suppressed.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. A system for controlling fuel injection for a multiple-displacement engine having cylinders and a respective solenoid-operated fuel injection valve for each cylinder, a throttle plate in an intake manifold communicating with the cylinders, a depressable accelerator pedal operatively connected to the throttle plate, and an electronic control unit, comprising:

switch means for rendering each solenoid-operated fuel injection valve respectively inoperative;

said accelerator pedal being arranged to be further depressed after a full throttle plate open position;

a throttle plate position sensor for producing an output signal in proportion to the throttle plate position;

an accelerator pedal position sensor for producing an output signal dependent on the accelerator pedal position;

a fuel injection control circuit responsive to said output signals of said throttle plate position sensor and said accelerator pedal position sensor for operating said switch means to cut off fuel to a corresponding of said cylinders, respectively;

said fuel injection control circuit being arranged to cut off the fuel to respective of said cylinders via corresponding of said switch means in accordance with idle cylinder patterns which are such that particular cylinders are not repeatedly idled, and such that the number of idling cylinders by the fuel cut-off is dependent on said output signals and progressively decreases with an increase of the depression degree of the accelerator pedal after the full throttle plate open position.

2. The system according to claim 1, wherein said fuel injection control circuit is such that the number of idling cylinders is constant whenever the throttle plate is other than in the full throttle plate open position.

* * * * *